US011396786B1

(12) United States Patent
Budde

(10) Patent No.: US 11,396,786 B1
(45) Date of Patent: Jul. 26, 2022

(54) WIPER PLUG

(71) Applicant: Weatherford Netherlands, B.V., Den Helder (NL)

(72) Inventor: Marcel Budde, Vlaardingen (NL)

(73) Assignee: Weatherford Netherlands, B.V., Den Helder (NL)

( * ) Notice: Subject to any disclaimer, the term of this patent is extended or adjusted under 35 U.S.C. 154(b) by 0 days.

(21) Appl. No.: 17/145,137

(22) Filed: Jan. 8, 2021

(51) Int. Cl.
*E21B 33/08* (2006.01)
*E21B 33/12* (2006.01)

(52) U.S. Cl.
CPC ..... *E21B 33/08* (2013.01); *E21B 33/1216* (2013.01)

(58) Field of Classification Search
CPC ..... E21B 33/16; E21B 33/165; E21B 33/167
See application file for complete search history.

(56) References Cited

U.S. PATENT DOCUMENTS 3,796,260 A * 3/1974 Bradley ..... E21B 33/16 166/153
4,671,358 A * 6/1987 Lindsey, Jr. ..... E21B 34/14 166/154
4,854,386 A * 8/1989 Baker ..... E21B 33/16 166/289
6,491,103 B2 12/2002 Allamon et al.
6,513,590 B2 2/2003 Allamon et al.
6,527,057 B2 3/2003 Fraser, III et al.
6,848,511 B1 2/2005 Jones et al.
6,945,326 B2 9/2005 Mikolajczyk
6,951,246 B2 10/2005 Tessier et al.
7,096,949 B2 8/2006 Weber et al.
8,201,634 B2 6/2012 Laurel et al.
9,004,173 B2 4/2015 Richard et al.
9,587,466 B2 3/2017 Burguieres et al.
10,132,139 B1 11/2018 Roberts et al.
10,260,306 B1 4/2019 Beckett et al.
10,648,272 B2 5/2020 Budde et al.
2004/0065435 A1* 4/2004 Tessier ..... E21B 33/16 166/153
2004/0251025 A1 12/2004 Giroux et al.
2018/0135378 A1 5/2018 Budde
2019/0128087 A1* 5/2019 Stair ..... E21B 33/16

OTHER PUBLICATIONS

International Search Report and Written Opinion dated Mar. 7, 2022 for Application No. PCT/EP2021/084761.

* cited by examiner

*Primary Examiner* — David Carroll
(74) *Attorney, Agent, or Firm* — Patterson + Sheridan, LLP

(57) ABSTRACT

A wiper plug includes a mandrel and a seal unit disposed about the mandrel. The seal unit has a body and one or more fins extending outwardly from the body. An anti-extrusion assembly is disposed about the mandrel, and is arranged to transition between an initial configuration and an energized configuration. The anti-extrusion assembly limits extrusion of at least a portion of the seal unit.

19 Claims, 13 Drawing Sheets

WIPER PLUG

BACKGROUND

Field

Embodiments of the present disclosure generally relate to plugs that are used during the cementing of liners, such as those used in oil, gas, and water wells.

Description of the Related Art

A wellbore is formed by using a drill bit on a drill string to drill through a geological formation. A drilling fluid, known as mud, is circulated to lubricate the drill bit, remove rock cuttings from the wellbore, and provide a hydrostatic pressure to counteract the in situ pressure of the geological formation. After drilling through the geological formation to a predetermined depth, the drill string and drill bit are removed, and the wellbore is lined by inserting a string of casing into the wellbore. At least a portion of the annulus between the inner surface of the wellbore and casing is filled with cement using a cementing operation. Typically, a cementing operation involves the pumping of a cement slurry through the casing, out of the bottom of the casing, and up the annulus.

A casing string is hung off from a wellhead located at the top of the wellbore. An equivalent string of tubulars that is hung off from a location within the wellbore below the wellhead is typically referred to as a liner. A liner is deployed to a desired depth in the wellbore using a workstring, and suspended from a previously-installed casing by using a liner hanger. A setting tool is then operated to set a liner hanger against the previously installed casing. The liner hanger may include slips riding outwardly on cones in order to engage the surrounding casing. The setting tool is typically operated by pumping a ball through the workstring to a seat located below the setting tool. Pressure is exerted on the seated ball to operate the setting tool. Thereafter, pressure is increased to release the ball and the ball seat. Usually, after actuating the liner hanger, the liner is cemented in place by pumping a cement slurry down the workstring, into the liner, out of the bottom of the liner, and into the annulus between the liner and the inner surface of the wellbore.

Wiper plugs are used to segregate the cement slurry from the drilling fluid while the cement slurry travels down the casing or liner. In a liner cementation operation, darts may be used to segregate the cement slurry from other fluids while the cement slurry travels down the workstring. Each dart picks up a corresponding wiper plug that is installed in an upper portion of the liner below the liner hanger to ensure the fluids remain segregated while the cement travels down through the liner. Sometimes, only one dart and a corresponding wiper plug is used; the dart and corresponding wiper plug operate to segregate the cement from fluid, such as drilling fluid, that is pumped after the cement to move the cement out of the bottom of the liner and into the annulus between the liner and the inner surface of the wellbore.

A wiper plug typically has an elastomeric body mounted on a mandrel and elastomeric external fins that bear against the inner wall of the casing. The fins wipe mud solids and other accumulated debris off the inner wall of the casing. The effectiveness of a wiper plug relies on at least one fin creating a seal against the surrounding casing or liner, and the body sealing against the mandrel. The elastomer material usually has a hardness that provides for structural robustness, such as for wiping of the casing or liner, and resistance to abrasion, yet is sufficiently malleable to be deformed so as to provide the necessary seals. However, the hardness decreases with increasing temperature, and thus at elevated temperatures within wellbores, the elastomeric body and the fins become susceptible to extrusion, which compromises their sealing capability.

Therefore, there is a need for an improved wiper plug design.

SUMMARY

The present disclosure generally relates to a wiper plug for use in a wellbore or other conduit, such as a pipeline.

In one embodiment, a wiper plug includes a mandrel having a nose portion at a leading end thereof. A seal unit, including a body and one or more fins extending outwardly from the body, is disposed about the mandrel. An anti-extrusion assembly is disposed about the mandrel at a leading end of the seal unit. The anti-extrusion assembly is arranged to transition between a first configuration, in which the anti-extrusion assembly is not energized, and a second configuration, in which the anti-extrusion assembly is energized. The nose portion protrudes beyond the anti-extrusion assembly.

In another embodiment, a wiper plug includes a mandrel and a seal unit disposed about the mandrel, the seal unit having a body and one or more fins extending outwardly from the body. An anti-extrusion assembly is disposed about the mandrel at a leading end of the seal unit. The anti-extrusion assembly is arranged to transition between a first configuration, in which the anti-extrusion assembly is not energized, and a second configuration, in which the anti-extrusion assembly is energized, in response to a pressure applied to an obturating object landed in the wiper plug.

In another embodiment, a wiper plug includes a mandrel and a seal unit disposed around the mandrel. The seal unit includes a body having an inner surface, a leading end, and a trailing end, and one or more fins extending outwardly from the body. The inner surface includes a first, generally cylindrical, portion and a second portion. The second portion includes an inwardly extending shoulder located between the first portion and the leading end and facing toward the trailing end. The shoulder is substantially perpendicular to a longitudinal axis of the mandrel. The second portion further includes a first taper between the shoulder and the leading end. The seal unit body has a first inner diameter at a first location on the first taper proximal to the leading end and a second inner diameter at a second location on the first taper distal from the leading end. The first inner diameter is greater than the second inner diameter.

In another embodiment, a method includes suspending a wiper plug from a support disposed in a tubular, and energizing an anti-extrusion assembly of the wiper plug while the wiper plug remains suspended from the support.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure concerns wiper plug designs in which extrusion of a resilient component is inhibited. During use, a tendency of a resilient component of a wiper plug to deform detrimentally with a consequential loss of sealing integrity is thereby mitigated. Wiper plugs of the present disclosure provide robust wiping of the inner surface of a casing or liner, and sealing against the casing or liner that is effective at elevated temperatures that exist in a wellbore.

Figure 1:
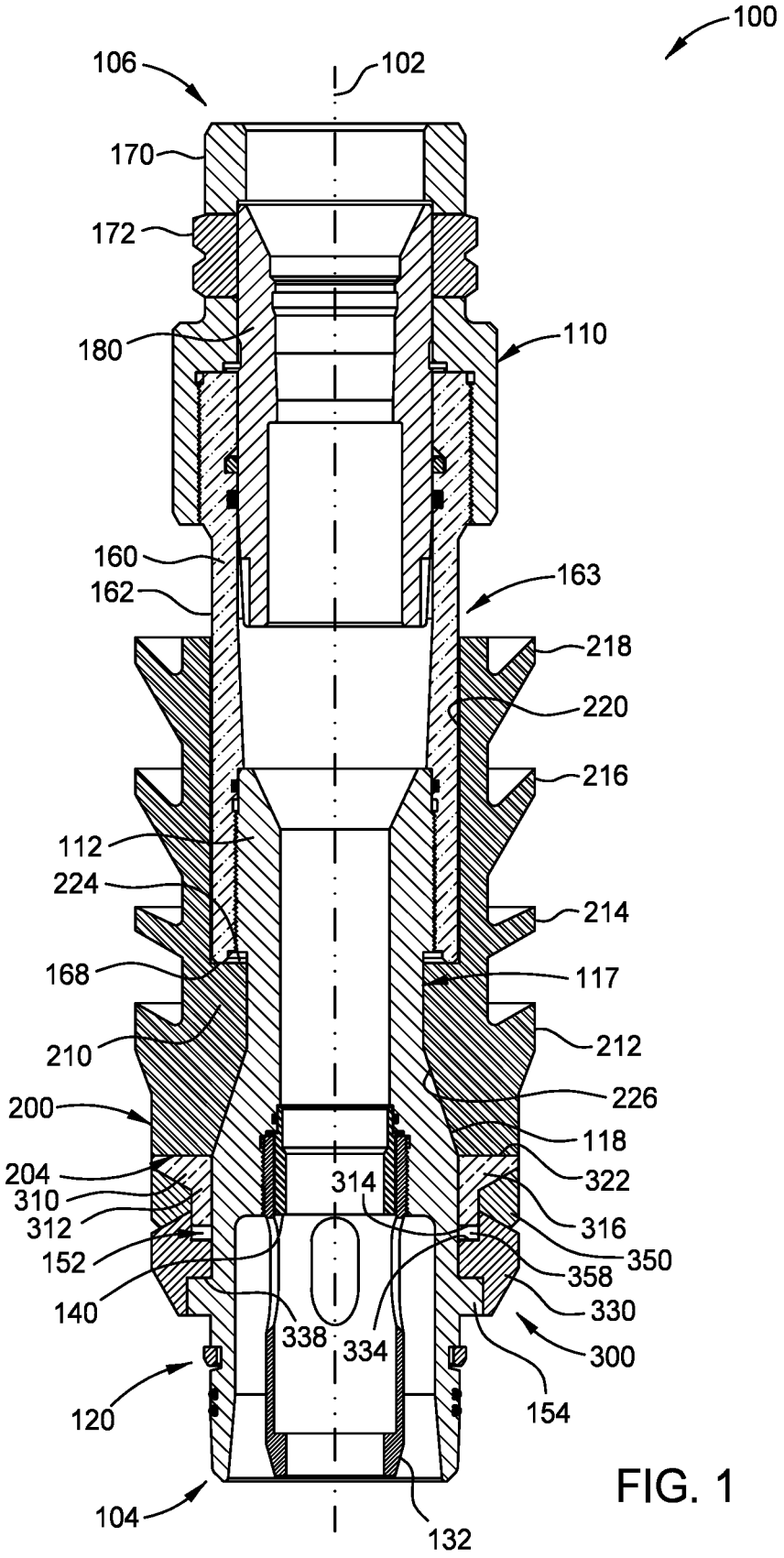
FIG. 1 is a longitudinal cross-sectional view of a wiper plug.
Figure 2:
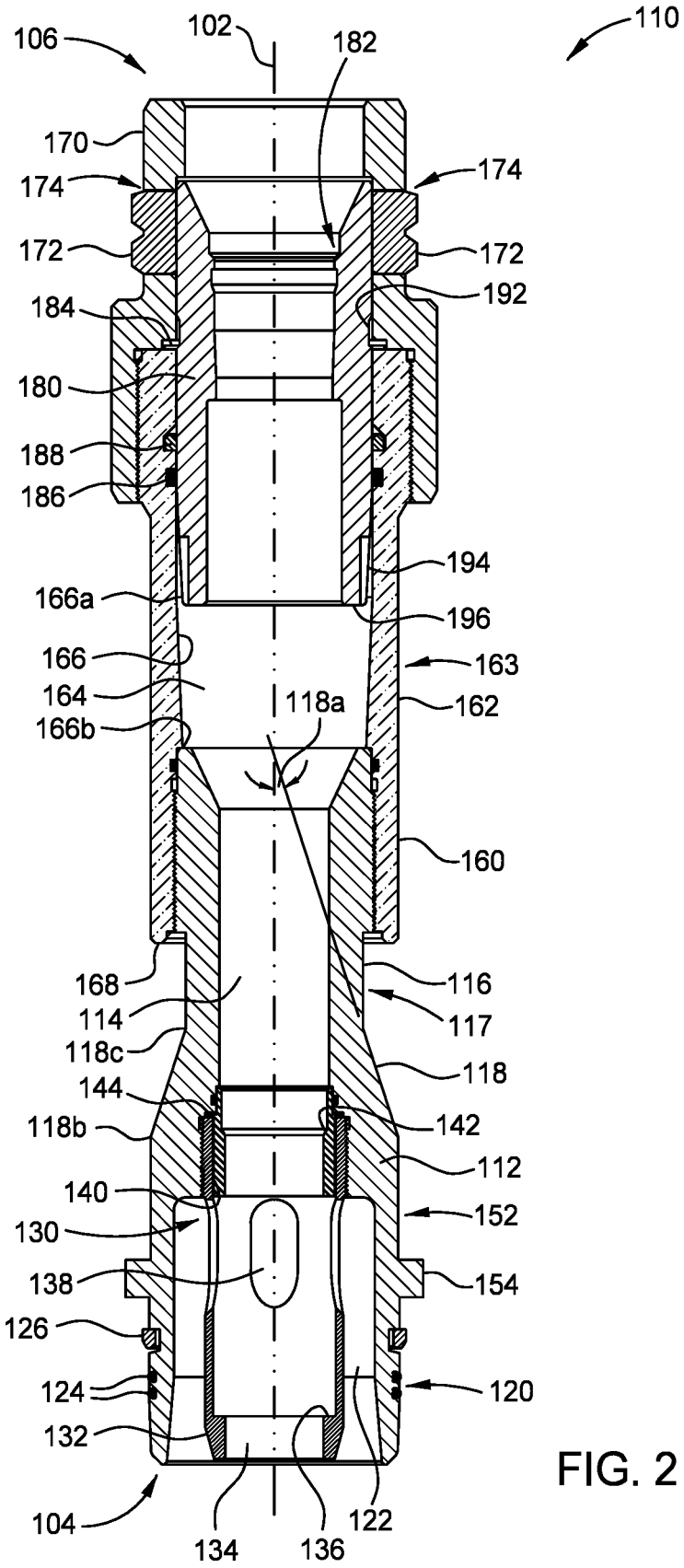
FIG. 2 is a longitudinal cross-sectional view of the wiper plug of FIG. 1, but with some components omitted.

FIG. 1 is a longitudinal cross-sectional view of a wiper plug 100. FIG. 2 is a longitudinal cross-sectional view of the wiper plug 100 of FIG. 1, but with some components omitted for clarity. The wiper plug 100 has a longitudinal axis 102, a leading end 104, and a trailing end 106. For the purpose of orientation, the leading end 104 and trailing end 106 define opposite ends of the wiper plug 100 along the longitudinal axis 102 according to a direction of travel (418, FIGS. 8A, 8B) through a tubular for which the wiper plug 100 is configured. The wiper plug 100 has a mandrel 110 that, as illustrated, includes a lower mandrel segment 112, a center mandrel segment 160, and an upper mandrel segment 170. In some embodiments, it is envisaged that the mandrel 110 may include greater than three segments. In some embodiments, it is envisaged that the mandrel 110 may include fewer than three segments. In some embodiments, it is envisaged that the mandrel 110 may be configured as a single component. For the purpose of orientation, the leading end 104 of the wiper plug 100 is also the leading end of the mandrel 110, and the trailing end 106 of the wiper plug 100 is also the trailing end of the mandrel 110.

The lower mandrel segment 112 has a longitudinal bore 114 therethrough. An outer surface 116 of the lower mandrel segment 112 includes a first portion 117 that is generally cylindrical and substantially aligned with the longitudinal axis 102. The outer surface 116 also includes a slope 118 describing a generally frustoconical profile extending at an acute angle 118*a* to the longitudinal axis 102. A first outer diameter of the lower mandrel segment 112 at a first end 118*b* of the slope 118 proximal to the leading end 104 is greater than a second outer diameter of the lower mandrel segment 112 at a second end 118*c* of the slope 118 distal from the leading end 104.

The outer surface 116 of the lower mandrel segment 112 includes a second portion 152 that is generally cylindrical and substantially aligned with the longitudinal axis 102. The slope 118 is located between the first 117 and second 152 generally cylindrical portions. The outer surface 116 of the lower mandrel segment 112 includes a ridge 154. The second generally cylindrical portion 152 is located between the ridge 154 and the slope 118.

The lower mandrel segment 112 includes a nose portion 120 located at the leading end 104. The nose portion 120 has a bore 122 with a diameter that is greater than a diameter of the bore 114 of the lower mandrel segment 112 at a location distal from the leading end 104. In some embodiments, it is envisaged that the nose portion 120 may have a bore 122 diameter that is less than or equal to the diameter of the bore 114 of the lower mandrel segment 112 at a location distal from the leading end 104. The nose portion 120 includes one or more seals 124 (two are illustrated) on an outer surface. The nose portion 120 includes a lock ring 126 on the outer surface. In some embodiments, it is envisaged that the one or more seals 124 and/or the lock ring 126 may be omitted.

The lower mandrel segment 112 includes a lower seat assembly 130. The lower seat assembly 130 includes a catcher 132 that extends into the bore 122 of the nose portion 120. The catcher 132 is generally tubular, having an end port 134 and one or more side ports 138. The catcher 132 includes a ledge 136 around the end port 134. A lower seat sleeve 140 is at least partially disposed in the catcher 132, and has a profile 142 configured to interact with an obturating object, such as a dart or a ball. The lower seat sleeve 140 is held in place by a releasable fastener 144, such as a shear ring, shear pin, collet, latch, or the like. In some embodiments, it is contemplated that the lower seat assembly 130 may be omitted.

The center mandrel segment 160 is coupled to the lower mandrel segment 112, and has an outer surface 162 including a portion 163 that is generally cylindrical and substantially aligned with the longitudinal axis 102. The center mandrel segment 160 also has a bore 164 that includes a taper 166 from a first bore diameter at a first location 166*a* distal from the lower mandrel segment 112 to a second smaller diameter at a second location 166*b* proximal to the lower mandrel segment 112. The center mandrel segment 160 is coupled to the upper mandrel segment 170. The upper mandrel segment 170 includes one or more retainers 172, such as locking dogs, collets, latches, and the like. As illustrated in FIG. 1, each retainer 172 is disposed in a corresponding opening 174 in the upper mandrel segment 170. The one or more retainers 172 secure the wiper plug 100 to a support (410, shown in FIG. 5A) for deployment.

An upper seat sleeve 180 having a profile 182 is at least partially disposed in the upper mandrel segment 170 and at least partially disposed in the center mandrel segment 160.

The profile 182 is configured to interact with an obturating object, such as a dart or a ball. The upper seat sleeve 180 extends across each opening 174 in the connector, and therefore maintains each retainer 172 in a radially extended position. The upper seat sleeve 180 is held in place by a releasable fastener 184, such as a shear ring, shear pin, collet, latch, or the like. An o-ring 186 provides a seal between the upper seat sleeve 180 and the center mandrel segment 160. A lock ring 188 in the center mandrel segment 160 is configured to engage a recess 192 in the upper seat sleeve 180, as described below. The upper seat sleeve 180 has an external taper 194 such that an outer diameter of the upper seat sleeve 180 at a location distal from a lower end 196 of the upper seat sleeve 180 is greater than an outer diameter of the upper seat sleeve 180 at a location proximal to the lower end 196 of the upper seat sleeve 180.

The mandrel 110—including at least one or more of the components of the lower mandrel segment 112, the center mandrel segment 160, or the upper mandrel segment 170—is made of a material that provides structural rigidity, such as a metal, a plastic, or a composite material, such as fiberglass. In some embodiments, it is contemplated that the mandrel 110 may be made of a material that may be readily disintegrated upon being drilled through by a standard oilfield drill bit or mill. For example, material may include aluminum. In some embodiments, it is contemplated that the mandrel 110 may be made of a material that may be readily dissolved by a suitable solvent. For example, the material may include polylactic acid, and the solvent may include water.

Figure 3:
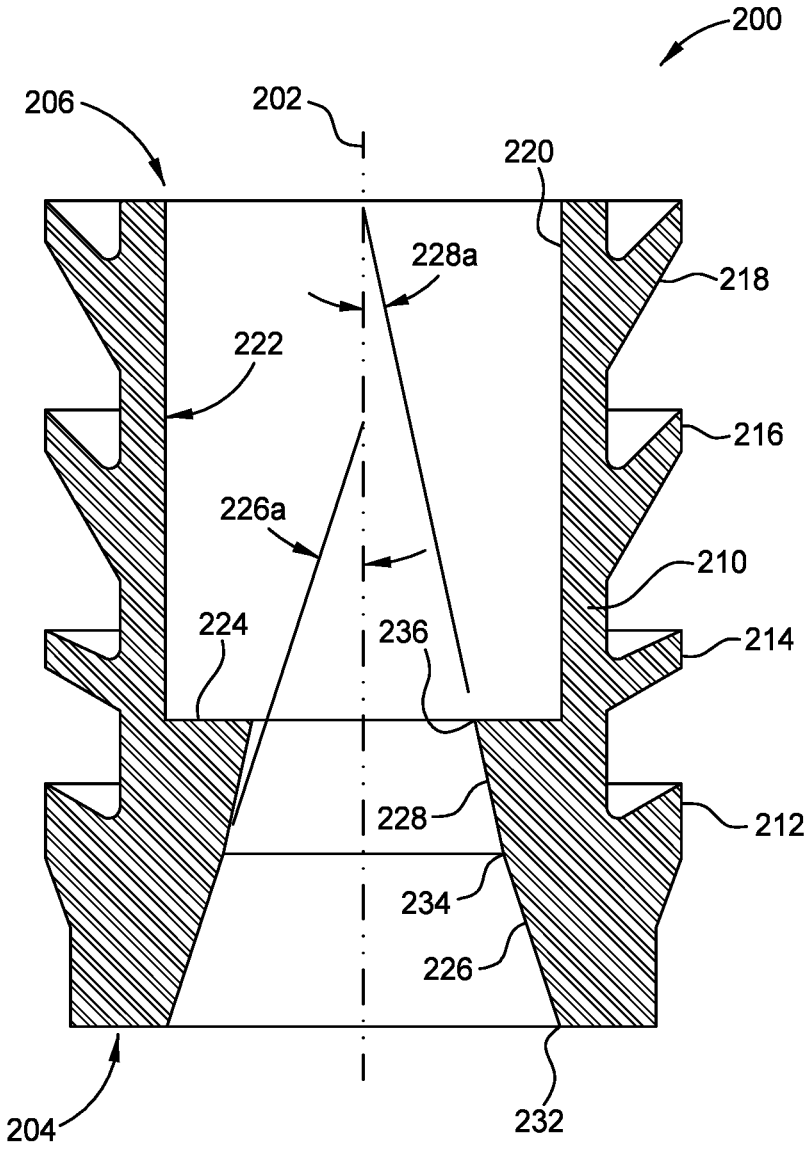
FIG. 3 is a longitudinal cross-sectional view of a component of the wiper plug of FIG. 1.

A seal unit 200 is disposed around the mandrel 110. The seal unit 200 is illustrated in FIG. 3. The seal unit 200 has a longitudinal axis 202. When assembled on the mandrel 110, the longitudinal axis 202 of the seal unit 200 is substantially coincident with the longitudinal axis 102 of the wiper plug 100. For example, the longitudinal axis 202 of the seal unit 200 may intersect the longitudinal axis 102 of the wiper plug 100 at an angle of from zero degrees to two degrees. For the purpose of orientation with the description, the seal unit 200 has a leading end 204 consistent with the leading end 104 of the wiper plug 100, and a trailing end 206 consistent with the trailing end 106 of the wiper plug 100.

The seal unit 200 has a body 210 from which a plurality of fins project outwardly. As illustrated, the seal unit 200 has a leading fin 212 located proximate to the leading end 204, a trailing fin 218 located proximate to the trailing end 206, and two intermediate fins 214, 216 located between the leading fin 212 and the trailing fin 218. As illustrated, the leading fin 212 is configured to perform both a sealing function against a surrounding surface and a wiping function of the surrounding surface when in operation. As illustrated, one intermediate fin 214 is configured to perform primarily a wiping function of a surrounding surface and secondarily a sealing function against the surrounding surface when in operation. As illustrated, the trailing fin 218 and one intermediate fin 216 are configured to perform primarily a sealing function against a surrounding surface and secondarily a wiping function of the surrounding surface when in operation. As illustrated, the body 210 and the fins 212, 214, 216, 218 form a unitary structure of the seal unit 200. However, it is also contemplated that the seal unit 200 may include individual segments. For example, each segment may include a body portion and a fin.

The seal unit 200 is made of a resilient material, such as an elastomer, that provides resistance to deformation, yet is sufficiently flexible to yield elastically when under load. It is contemplated that the elastomer may have properties tailored for different parts or sections of the seal unit 200. For example, one or more fins 212/214/216/218 may include an elastomer possessing a greater stiffness than one or more other fins 212/214/216/218 and/or the body 210. In some embodiments, it is contemplated that the seal unit 200 may not include additional materials. However, in some embodiments, it is contemplated that the seal unit 200 may include additional materials. For example, the seal unit 200 may include one or more support members in the body 210 and/or in one or more fins 212/214/216/218. The one or more support members may provide enhanced stiffness to one or more sections of the seal unit 200. The one or more support members may be made of metal, such as aluminum, or a composite, such as fiberglass.

Although four fins 212, 214, 216, 218 are illustrated, it is contemplated that the seal unit 200 may have any suitable number of fins, such as one fin, two fins, three fins, four fins, five fins, six fins, seven fins, or more than seven fins. Additionally, it is contemplated that any suitable number of the fins of the seal unit 200 (such as no fins, one fin, two fins, three fins, or more than three fins) may be configured to perform primarily a wiping function of a surrounding surface and secondarily a sealing function against the surrounding surface when in operation. Additionally, it is contemplated that any suitable number of the fins of the seal unit 200 (such as no fins, one fin, two fins, three fins, or more than three fins) may be configured to primarily a sealing function against a surrounding surface and secondarily a wiping function of the surrounding surface when in operation.

The body 210 has an inner surface 220 that includes a portion 222 extending from the trailing end 206 toward the leading end 204 that is generally cylindrical and substantially aligned with the longitudinal axis 202. In some embodiments, it is contemplated that the portion 222 of the inner surface 220 extending from the trailing end 206 toward the leading end 204 may be undulating. In some embodiments, it is contemplated that the portion 222 of the inner surface 220 extending from the trailing end 206 toward the leading end 204 may not be generally cylindrical. For example, the portion 222 of the inner surface 220 extending from the trailing end 206 toward the leading end 204 may describe a generally frustoconical profile.

The inner surface 220 of the body 210 includes an inwardly extending shoulder 224 located between the leading end 204 and the portion of the inner surface 220 that extends from the trailing end 206 toward the leading end 204. The shoulder 224 faces toward the trailing end 206 and extends substantially perpendicular to the longitudinal axis 202. For example, the shoulder 224 may extend at angle of from eighty-five to ninety degrees to the longitudinal axis 202. In some embodiments, it is contemplated that the shoulder 224 may extend at an acute angle to the longitudinal axis 202. For example, the shoulder 224 may extend at an acute angle toward the trailing end 206 and toward the longitudinal axis 202. Alternatively, or additionally, the shoulder 224 may include a profile, such as a "V" shaped profile.

The inner surface 220 of the body 210 includes a first taper 226 between the shoulder 224 and the leading end 204. As illustrated, the first taper 226 describes a generally frustoconical profile, although one or more alternative profiles, such as a curve, are contemplated in some embodiments. The first taper 226 is shown having an angle **226*a* with respect to the longitudinal axis 202. The first taper 226 is oriented such that an inner diameter of the body 210 at a first location 232 on the first taper 226 proximal to the leading end 204 is greater than an inner diameter of the body 210 at a second location 234 distal from the leading end 204**.

The inner surface 220 of the body 210 includes a second taper 228 between the shoulder 224 and the first taper 226. The second taper 228 describes a generally frustoconical profile, although one or more alternative profiles, such as a curve or other polygonal profile, are contemplated in some embodiments. The second taper 228 is shown having an angle 228*a* with respect to the longitudinal axis 202. The second taper 228 is oriented such that an inner diameter of the body 210 at the second location 234 is greater than an inner diameter of the body 210 at a third location 236 on the second taper 228, the third location 236 being proximal to the shoulder 224. In this embodiment, the angle 228*a* is different from the angle 226*a*. However, it is contemplated the first and second tapers 226, 228 may have the same or different angles 226*a*, 228*a* or alternative profiles.

The first location 232 is on the first taper 226 at the leading end 204, the second location 234 is at a meeting point of the first taper 226 and the second taper 228, and the third location 236 is at the shoulder 224. In some embodiments, it is contemplated that the first location 232 may be at any location between the leading end 204 and the shoulder 224. In some embodiments, it is contemplated that the second location 234 may be at any location between the first location 232 and the shoulder 224. In some embodiments, it is contemplated that the third location 236 may be at any location between the second location 234 and the shoulder 224. In some embodiments, it is contemplated that the second taper 228 may not meet with the first taper 226. For example, the inner surface 220 may include a generally cylindrical section and/or an enlarged section between the first taper 226 and the second taper 228.

In some embodiments, it is contemplated that the second taper 228 may be omitted. For example, the inner surface 220 may include a generally cylindrical section and/or an enlarged section between the first taper 226 and the shoulder 224. Alternatively, the first taper 226 may extend up to the shoulder 224.

Returning to FIG. 1, the seal unit 200 is at least partially disposed around the lower mandrel segment 112 and at least partially disposed around the center mandrel segment 160. As illustrated, the generally cylindrical portion 222 of the inner surface 220 of the seal unit 200 that extends from the trailing end 206 of the seal unit 200 is disposed around the generally cylindrical portion 163 of the outer surface 162 of the center mandrel segment 160. Additionally, the first taper 226 of the inner surface 220 of the seal unit 200 is disposed around the slope 118 of the outer surface 116 of the lower mandrel segment 112. As illustrated, the angle of the first taper 226 is substantially equal (such as differing by zero degrees to two degrees) to the angle 118*a* of the slope 118. In some embodiments, it is contemplated that the angle of the first taper 226 may be greater than the angle 118*a* of the slope 118. In some embodiments, it is contemplated that the angle of the first taper 226 may be less than the angle 118*a* of the slope 118.

In the configuration illustrated in FIG. 1, and with reference to FIGS. 1, 2, and 3, the second taper 228 of the inner surface 220 of the seal unit 200 is disposed around the first generally cylindrical portion 117 of the outer surface 116 of the lower mandrel segment 112. It is contemplated that the second taper 228 of the inner surface 220 of the seal unit 200 may be dimensioned such that the second taper 228 provides an interference fit around the first generally cylindrical portion 117 of the outer surface 116 of the lower mandrel segment 112. For example, the inner diameter of the body 210 of the seal unit 200 at the third location 236 (proximal to the shoulder 224) on the second taper 228 may be less than an outer diameter of the first generally cylindrical portion 117 of the outer surface 116 of the lower mandrel segment 112. In such an example, the second taper 228 provides an interference fit around the first generally cylindrical portion 117 of the outer surface 116 of the lower mandrel segment 112 even if the inner diameter of the body 210 of the seal unit 200 at the second location 234 is greater than or equal to the outer diameter of the first generally cylindrical portion 117 of the outer surface 116 of the lower mandrel segment 112.

In embodiments in which the second taper 228 of the inner surface 220 of the seal unit 200 is omitted, and there exists a portion of the seal unit 200 body 210 between the first taper 226 of the inner surface 220 and the shoulder 224, it is contemplated that the portion of the seal unit 200 between the first taper 226 of the inner surface 220 and the shoulder 224 may be disposed around the first generally cylindrical portion 117 of the outer surface 116 of the lower mandrel segment 112.

In embodiments in which the first taper 226 of the inner surface 220 of the seal unit 200 extends to the shoulder 224 of the inner surface 220 of the seal unit 200, it is contemplated that at least a portion of the first taper 226 may be disposed around the first generally cylindrical portion 117 of the outer surface 116 of the lower mandrel segment 112. Additionally, in such embodiments, it is contemplated the first taper 226 of the inner surface 220 of the seal unit 200 may be dimensioned such that the first taper 226 provides an interference fit around the first generally cylindrical portion 117 of the outer surface 116 of the lower mandrel segment 112.

Figure 4:
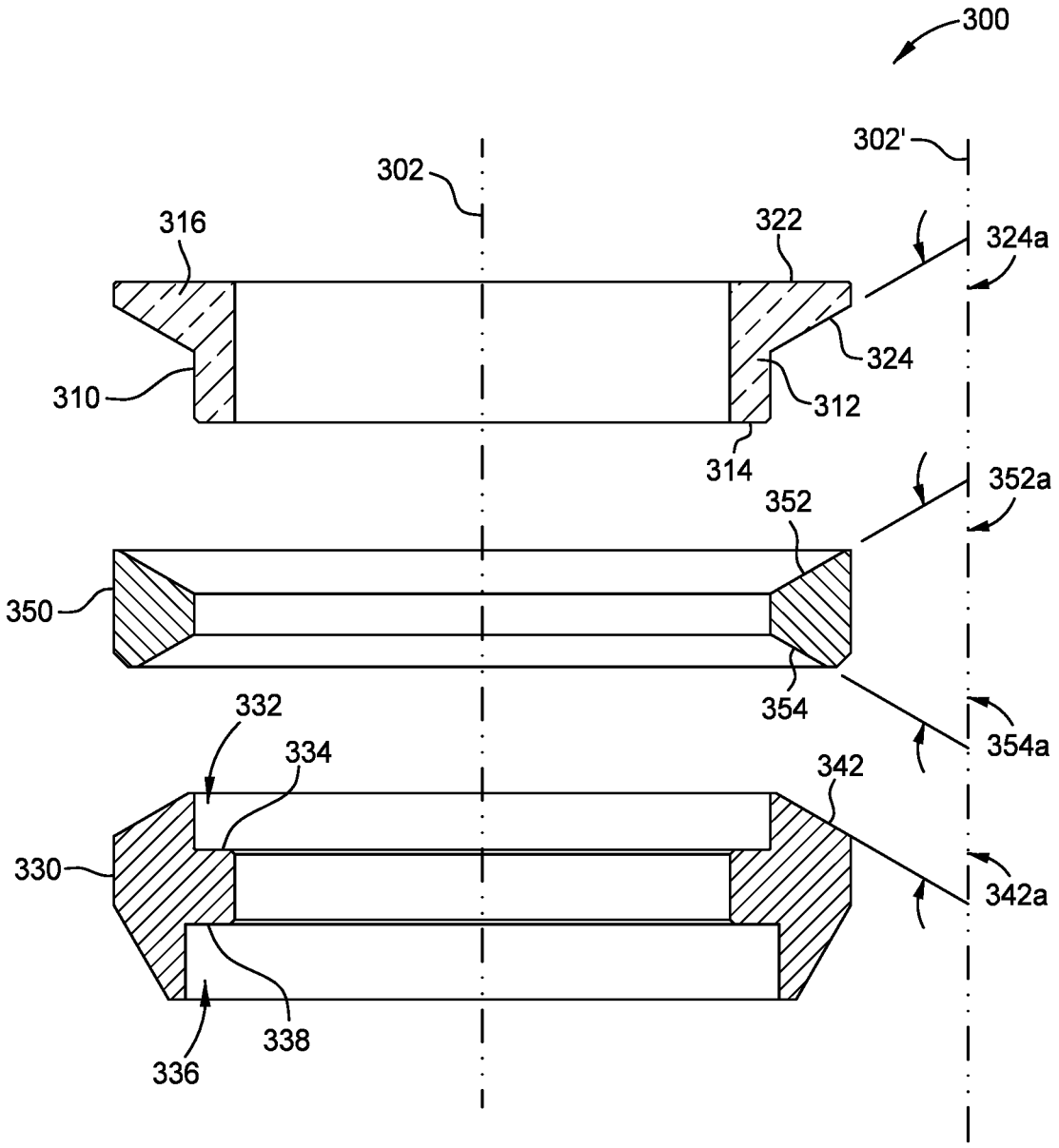
FIG. 4 is a longitudinal cross-sectional view of some components of the wiper plug of FIG. 1.

Continuing with FIG. 1, an anti-extrusion assembly 300 is disposed around the lower mandrel segment 112 between the seal unit 200 and the leading end 104 of the wiper plug 100. The anti-extrusion assembly 300 is disposed around the second generally cylindrical portion 152 of the outer surface 116 of the lower mandrel segment 112. The anti-extrusion assembly 300 is illustrated in detail in an exploded cross-sectional view in FIG. 4. The anti-extrusion assembly 300 has a longitudinal axis 302 that, in use, is substantially coincident with the longitudinal axis 102 of the wiper plug 100. For example, the longitudinal axis 302 of the anti-extrusion assembly 300 may intersect the longitudinal axis 102 of the wiper plug 100 at an angle of from zero degrees to two degrees. The anti-extrusion assembly 300 includes a setting ring 310, a retaining ring 330, and a ductile ring 350 located between the setting ring 310 and the retaining ring 330.

The setting ring 310 has a base 312 and an annular projection 316 extending outwardly from the base 312. The base 312 extends longitudinally from the projection 316. The projection 316 has a first surface 322 that, in use, faces the trailing end 106 of the wiper plug 100. The first surface 322 is illustrated as being substantially perpendicular to the longitudinal axis 302. For example, the first surface 322 may extend at angle of from eighty-five to ninety degrees to the longitudinal axis 202. However, in some embodiments, the first surface 322 may include a portion that is frustoconical, and thus may be at an acute angle to the longitudinal axis 302. For example, the first surface 322 may include a portion that extends outwardly from the base 312 and toward the trailing end 106 of the wiper plug 100. The projection 316 has a second surface 324 that, in use, faces the leading end 104 of the wiper plug 100. The second surface 324 is frustoconical, and is at an acute angle 324*a* to datum line 302' which is parallel to the longitudinal axis 302.

The retaining ring 330 has a first recess 332 configured to accommodate at least a portion of the base 312 of the setting ring 310. The first recess 332 is at least partially defined by a first shoulder 334 that, in use, faces the trailing end 106 of the wiper plug 100. The retaining ring 330 has a second recess 336 configured to accommodate at least a portion of the ridge 154 of the lower mandrel segment 112. The second recess 336 is at least partially defined by a second shoulder 338 that, in use, faces the ridge 154 of the lower mandrel segment 112. The retaining ring 330 has a surface 342 that, in use, faces the trailing end 106 of the wiper plug 100. The surface is frustoconical, and is at an acute angle 342*a* to datum line 302' which is parallel to the longitudinal axis 302.

The ductile ring 350 is made from a material, such as polytetrafluoroethylene, that possesses flexural strength and is resistant to tearing. The ductile ring 350 has a first surface 352 that, in use, faces the trailing end 106 of the wiper plug 100. The first surface 352 is frustoconical, and is at an acute angle 352*a* to datum line 302' which is parallel to the longitudinal axis 302. The ductile ring 350 has a second surface 354 that, in use, faces the leading end 104 of the wiper plug 100. The second surface 354 is frustoconical, and is at an acute angle 354*a* to datum line 302' which is parallel to the longitudinal axis 302.

In some embodiments, it is contemplated that the angle 324*a* of the second surface 324 of the projection 316 of the setting ring 310 may be substantially equal to the angle 352*a* of the first surface 352 of the ductile ring 350. For example, the angle 324*a* may differ from the angle 352*a* by zero to two degrees. In some embodiments, it is contemplated that the angle 324*a* of the second surface 324 of the projection 316 of the setting ring 310 may be less than the angle 352*a* of the first surface 352 of the ductile ring 350. In some embodiments, it is contemplated that the angle 324*a* of the second surface 324 of the projection 316 of the setting ring 310 may be greater than the angle 352*a* of the first surface 352 of the ductile ring 350.

In some embodiments, it is contemplated that the angle 354*a* of the second surface 354 of the ductile ring 350 may be substantially equal to the angle 352*a* of the first surface 352 of the ductile ring 350. For example, the angle 354*a* may differ from the angle 352*a* by zero to two degrees. In some embodiments, it is contemplated that the angle 354*a* of the second surface 354 of the ductile ring 350 may be less than the angle 352*a* of the first surface 352 of the ductile ring 350. In some embodiments, it is contemplated that the angle 354*a* of the second surface 354 of the ductile ring 350 may be greater than the angle 352*a* of the first surface 352 of the ductile ring 350.

In some embodiments, it is contemplated that the angle 354*a* of the second surface 354 of the ductile ring 350 may be substantially equal to the angle 342*a* of the surface 342 of the retaining ring 330. For example, the angle 354*a* may differ from the angle 342*a* by zero to two degrees. In some embodiments, it is contemplated that the angle 354*a* of the second surface 354 of the ductile ring 350 may be less than the angle 342*a* of the surface 342 of the retaining ring 330. In some embodiments, it is contemplated that the angle 354*a* of the second surface 354 of the ductile ring 350 may be greater than the angle 342*a* of the surface 342 of the retaining ring 330.

As illustrated in FIG. 1, when the anti-extrusion assembly 300 is mounted on the lower mandrel segment 112, the nose portion 120 protrudes beyond the anti-extrusion assembly 300. In some embodiments, it is contemplated that the nose portion 120 may not protrude beyond the anti-extrusion assembly 300. In some embodiments, it is contemplated that the nose portion 120 may be omitted.

As illustrated in FIG. 1, when the anti-extrusion assembly 300 is mounted on the lower mandrel segment 112, the second recess 336 of the retaining ring 330 accommodates at least a portion of the ridge 154 of the lower mandrel segment 112. The second shoulder 338 of the second recess 336 of the retaining ring 330 is illustrated as abutting the ridge 154 of the lower mandrel segment 112. However, in some embodiments, it is contemplated that second shoulder 338 of the second recess 336 of the retaining ring 330 may not abut the ridge 154 of the lower mandrel segment 112.

The setting ring 310 is located between the retaining ring 330 and the seal unit 200, and the ductile ring 350 is located between the projection 316 of the setting ring 310 and the frustoconical surface of the retaining ring 330. The second surface 324 of the projection 316 of the setting ring 310 abuts the first surface 352 of the ductile ring 350. The second surface 354 of the ductile ring 350 abuts the frustoconical surface of the retaining ring 330.

The anti-extrusion assembly 300 is configured such that movement of the setting ring 310 toward the retaining ring 330 compresses the ductile ring 350, resulting in deformation of the ductile ring 350. The deformation of the ductile ring 350 transitions the ductile ring 350 from a radially retracted condition to a radially extended condition. The base 312 of the setting ring 310 extends into the first recess 332 of the retaining ring 330. A gap 358 exists between the first shoulder 334 of the first recess 332 of the retaining ring 330 and the end 314 of the base 312 that extends from the projection 316 into the first recess 332 of the retaining ring 330. An interaction between the first shoulder 334 of the first recess 332 of the retaining ring 330 and an end 314 of the base 312 of the setting ring 310 limits the extent to which the setting ring 310 may move toward the retaining ring 330, and therefore limits the extent to which the ductile ring 350 may be deformed.

Upon mounting the anti-extrusion assembly 300 onto the lower mandrel segment 112, the ductile ring 350 is disposed around, and in contact with, a portion of the base 312 of the setting ring 310 that does not extend into the first recess 332 of the retaining ring 330. In some embodiments, it is contemplated that the base 312 of the setting ring 310 may not extend into the first recess 332 of the retaining ring 330 upon mounting the anti-extrusion assembly 300 onto the lower mandrel segment 112. In some embodiments, it is contemplated that the ductile ring 350 may not be disposed around the base 312 of the setting ring 310. For example, the ductile ring 350 may be disposed around, and in contact with, the second cylindrical portion 152 of the outer surface 116 of the lower mandrel segment 112.

FIG. 1 illustrates that the leading end 204 of the seal unit 200 abuts the anti-extrusion assembly 300 at the first surface 322 of the projection 316 of the setting ring 310. However, in some embodiments, it is contemplated that upon assembly of the wiper plug 100, the leading end 204 of the seal unit 200 may not abut the anti-extrusion assembly 300. Additionally, the shoulder 224 of the body 210 of the seal unit 200 is disposed proximal to, and facing, an end 168 of the center mandrel segment 160. In some embodiments, it is contemplated that upon assembly of the wiper plug 100, the shoulder 224 of the body 210 of the seal unit 200 abuts the end 168 of the center mandrel segment 160. In some embodiments, it is contemplated that upon assembly of the wiper plug 100, the shoulder 224 of the body 210 of the seal unit 200 bears against the end 168 of the center mandrel segment 160.

In embodiments in which upon assembly of the wiper plug 100, the shoulder 224 of the body 210 of the seal unit 200 bears against the end 168 of the center mandrel segment 160 and the leading end 204 of the seal unit 200 abuts the anti-extrusion assembly 300, it is contemplated that the seal unit 200 may apply a preload to the anti-extrusion assembly 300. In some embodiments, it is contemplated that the preload may cause the setting ring 310 to apply sufficient force on the ductile ring 350 to deform the ductile ring 350. For example, an outer diameter of the ductile ring 350 may become enlarged. In some embodiments, it is contemplated that the preload may not cause the setting ring 310 to apply sufficient force on the ductile ring 350 to deform the ductile ring 350.

In some embodiments, a wiper plug includes a mandrel and a seal unit disposed around the mandrel. The seal unit includes a body having an inner surface, a leading end, and a trailing end, and one or more fins extending outwardly from the body. The inner surface includes a first, generally cylindrical, portion and a second portion. The second portion includes an inwardly extending shoulder located between the first portion and the leading end and facing toward the trailing end. The shoulder is substantially perpendicular to a longitudinal axis of the mandrel. The second portion further includes a first taper between the shoulder and the leading end. The seal unit body has a first inner diameter at a first location on the first taper proximal to the leading end and a second inner diameter at a second location on the first taper distal from the leading end. The first inner diameter is greater than the second inner diameter.

In some embodiments, an outer surface of the mandrel includes a slope, and the first taper is disposed adjacent the slope. In some embodiments, the inner surface of the seal unit further includes a second taper between the shoulder and the first taper. In some embodiments, the body of the seal unit has a third inner diameter at a third location on the second taper proximal to the shoulder, the third inner diameter less than the second inner diameter. In some embodiments, the wiper plug includes an anti-extrusion assembly disposed about the mandrel at the leading end of the seal unit.

Figure 5A:
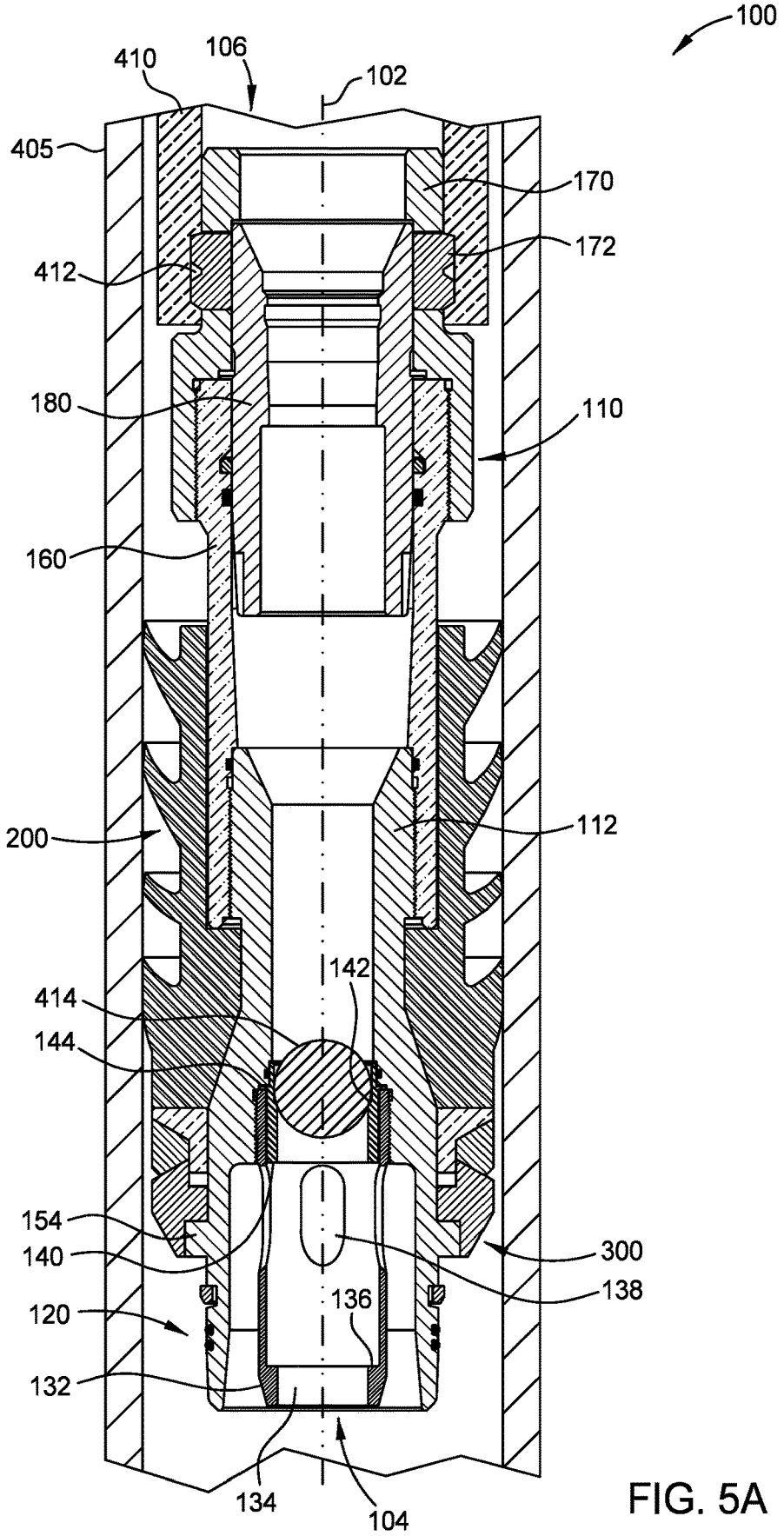
FIG. 5A is a longitudinal cross-sectional view of the wiper plug of FIG. 1 during an exemplary phase of operation.

FIGS. 5A to 9 illustrate the wiper plug 100 during several stages of operation. The wiper plug 100 is inserted into a bore, such as a wellbore or other bore, such as a pipeline. In FIG. 5A, the wiper plug 100 is illustrated disposed within a tubular 405. It is contemplated that the tubular 405 may be a liner or a casing of a wellbore. The wiper plug 100 is suspended from a support 410, such as a portion of a liner hanger running/setting tool. Each retainer of the wiper plug 100 projects radially outward into a recess 412 of the support 410. In some embodiments, it is contemplated that the recess 412 may extend around an entire inner circumference of the support 410. The upper seat sleeve 180 in the position shown in FIG. 5A prevents each retainer from moving radially inwardly.

A first obturating object, shown in FIG. 5A as a ball 414, is dropped into the wellbore, and conveyed by gravity and/or by pumping a fluid through a work string (not shown) to the wiper plug 100. In FIG. 5A, the ball 414 is illustrated as having landed on the profile 142 of the lower seat sleeve 140. The ball 414 landed on the profile 142 of the lower seat sleeve 140 blocks fluid communication through the wiper plug 100. Pressure is exerted against the ball 414, and upon reaching a first threshold, triggers activation of one or more tools in the wellbore. For example, the pressure may cause a liner hanger to become anchored in the wellbore.

Figure 5B:
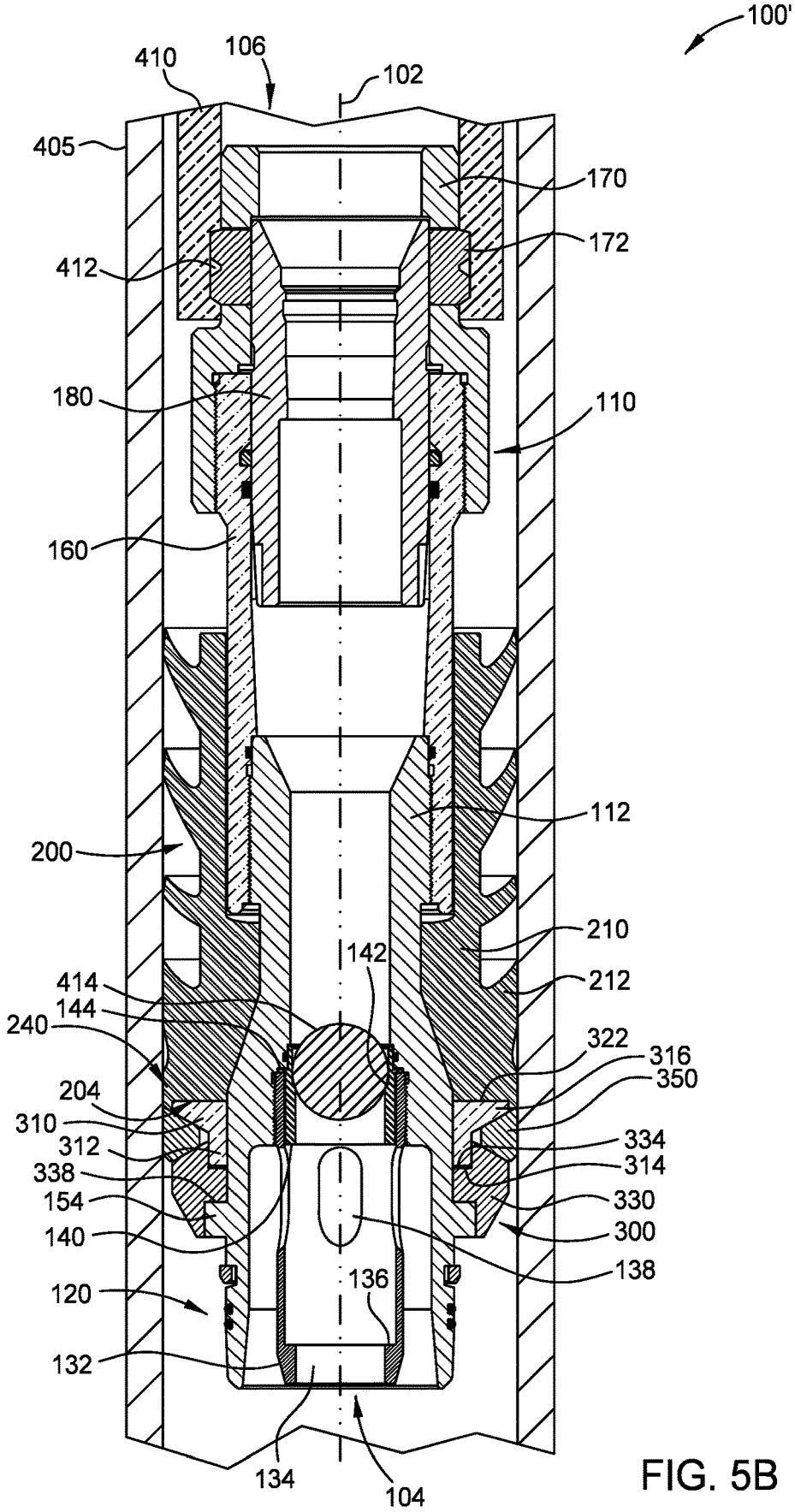
FIG. 5B is a longitudinal cross-sectional view of an embodiment of the wiper plug of FIG. 1 during the exemplary phase of operation of FIG. 5A.

FIG. 5B illustrates a variation of FIG. 5A in the deployment of the wiper plug 100. In FIG. 5B, wiper plug 100' represents at least one embodiment of the wiper plug 100 in which the anti-extrusion assembly 300 is at least partially energized when pressure is exerted against the ball 414. In some embodiments, it is contemplated that the energizing of the anti-extrusion assembly 300 may result from a preload applied by the seal unit 200, such as described above. Alternatively, or additionally, in some embodiments it is contemplated that the energizing of the anti-extrusion assembly 300 may result from the pressure exerted against the ball 414 also being exerted against the seal unit 200 in the annular space 408 between the mandrel 110 and the tubular 405. For example, pressure exerted against the ball 414 may be communicated to the annular space 408 via a port in the support 410 and/or around the one or more retainers 172. It is contemplated that the preload and/or pressure exerted on the seal unit 200 may result in a force being transferred from the seal unit 200 to the first surface 322 of the projection 316 of the setting ring 310 of the anti-extrusion assembly 300.

As illustrated in FIG. 5B, a force of sufficient magnitude applied via the seal unit 200 to the setting ring 310 of the anti-extrusion assembly 300 causes the setting ring 310 to move toward the retaining ring 330. Because the second shoulder 338 of the second recess 336 of the retaining ring 330 abuts the ridge 154 of the lower mandrel segment 112, the retaining ring 330 is prevented from moving away from the setting ring 310. Therefore, movement of the setting ring 310 toward the retaining ring 330 compresses the ductile ring 350, resulting in deformation of the ductile ring 350.

The configuration of the second surface 324 of the projection 316 of the setting ring 310, the first 352 and second 354 surfaces of the ductile ring 350, and the corresponding surface 342 of the retaining ring 330 promote deformation of the ductile ring 350 radially outward such that an outer diameter of the ductile ring 350 becomes enlarged, as illustrated in FIG. 5B. In some embodiments, it is contemplated that the outer diameter of the ductile ring 350 may become enlarged to the extent that the ductile ring 350 contacts the tubular 405. In some embodiments, it is contemplated that the ductile ring 350 makes a 360 degree contact with the tubular 405. In other embodiments, it is contemplated that the ductile ring 350 may not contact the tubular 405. In some embodiments, it is contemplated that the extent to which the ductile ring 350 may be deformed outwardly from between the projection 316 of the setting ring 310 and the retaining ring 330 is limited at least in part by the end 314 of the base 312 of the setting ring contacting the first shoulder 334 of the first recess 332 of the retaining ring 330.

Additionally, the force imparted on the seal unit 200 by the pressure applied on the displacement fluid may cause at least a portion 240 of the seal unit 200 to become extruded, as exemplified in FIG. 5B. It is contemplated that a susceptibility of the seal unit 200 to extrusion may be exacerbated by exposure to the elevated temperatures that typically exist in wellbores. Extrusion of a fin 212/214/216/218 of the seal unit 200 may compromise the integrity of the seals between the fin 212/214/216/218 and the surrounding tubular 405. However for the wiper plug 100' of the present disclosure, as shown in FIG. 5B, extrusion of the seal unit 200 at the leading end 204 of the seal unit 200 is limited by the anti-extrusion assembly 300. Thus, extrusion of the leading end 204 is restricted, and extrusion of the seal unit at the leading fin 212 is inhibited. Hence, sealing integrity of at least the leading fin 212 against the surrounding tubular 405 is maintained.

Figure 6A:
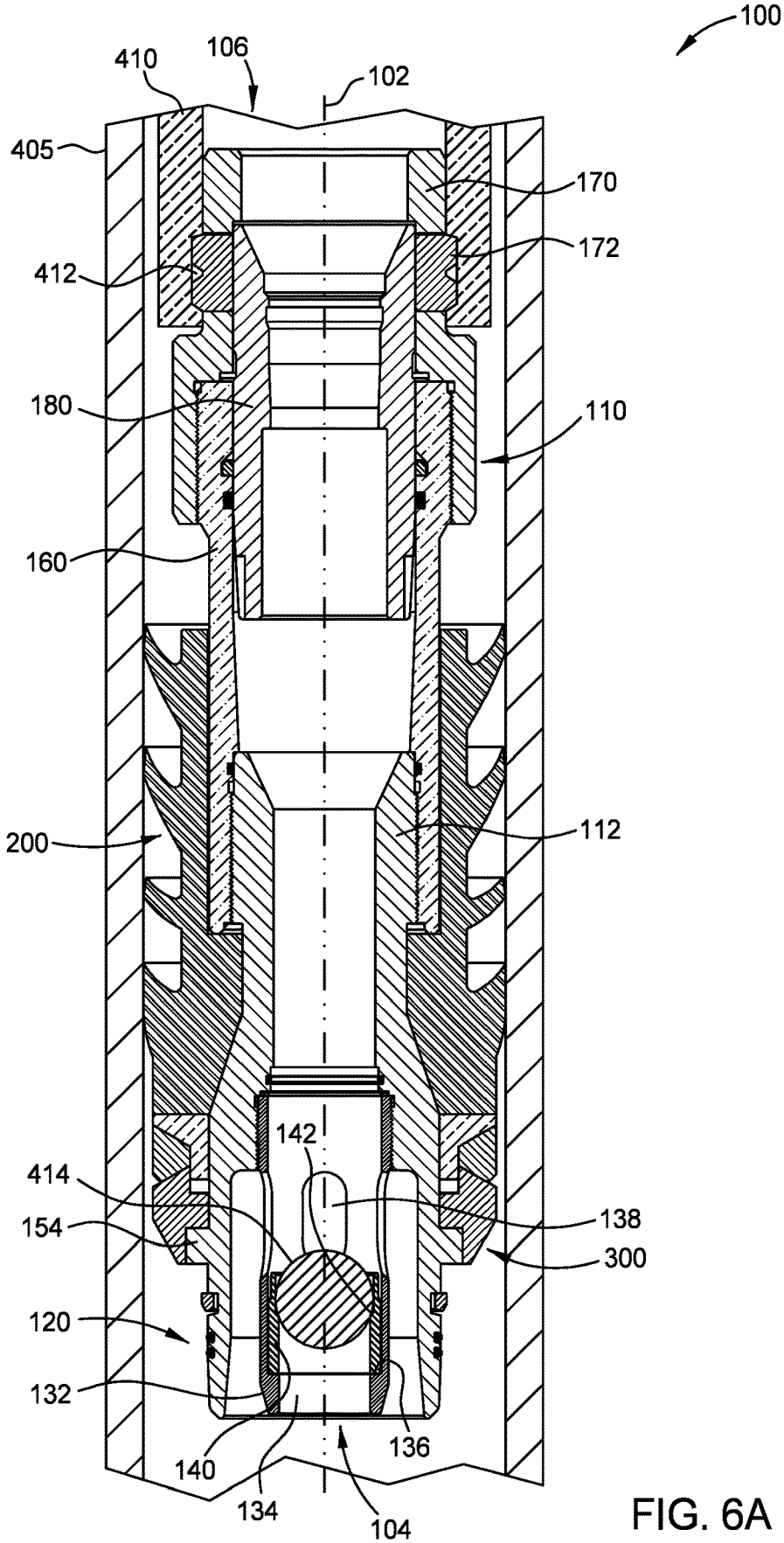
FIG. 6A is a longitudinal cross-sectional view of the wiper plug of FIG. 1 during an exemplary phase of operation.

Further application of pressure against the ball 414 to a second threshold that is higher than the first threshold causes the release of the lower seat sleeve 140. For example, the force on the lower seat sleeve 140 resulting from the pressure may cause the releasable fastener 144 to fail. FIG. 6A illustrates a continuation of the operation depicted in FIG. 5A, and shows the wiper plug 100 after the release of the lower seat sleeve 140. The lower seat sleeve 140 and the ball 414 move into the catcher 132; the lower seat sleeve 140 rests against the ledge 136 around the end port 134 of the catcher 132. Fluid communication through the wiper plug 100 is now reestablished since fluid may travel through the one or more side ports 138 of the catcher 132.

Figure 6B:
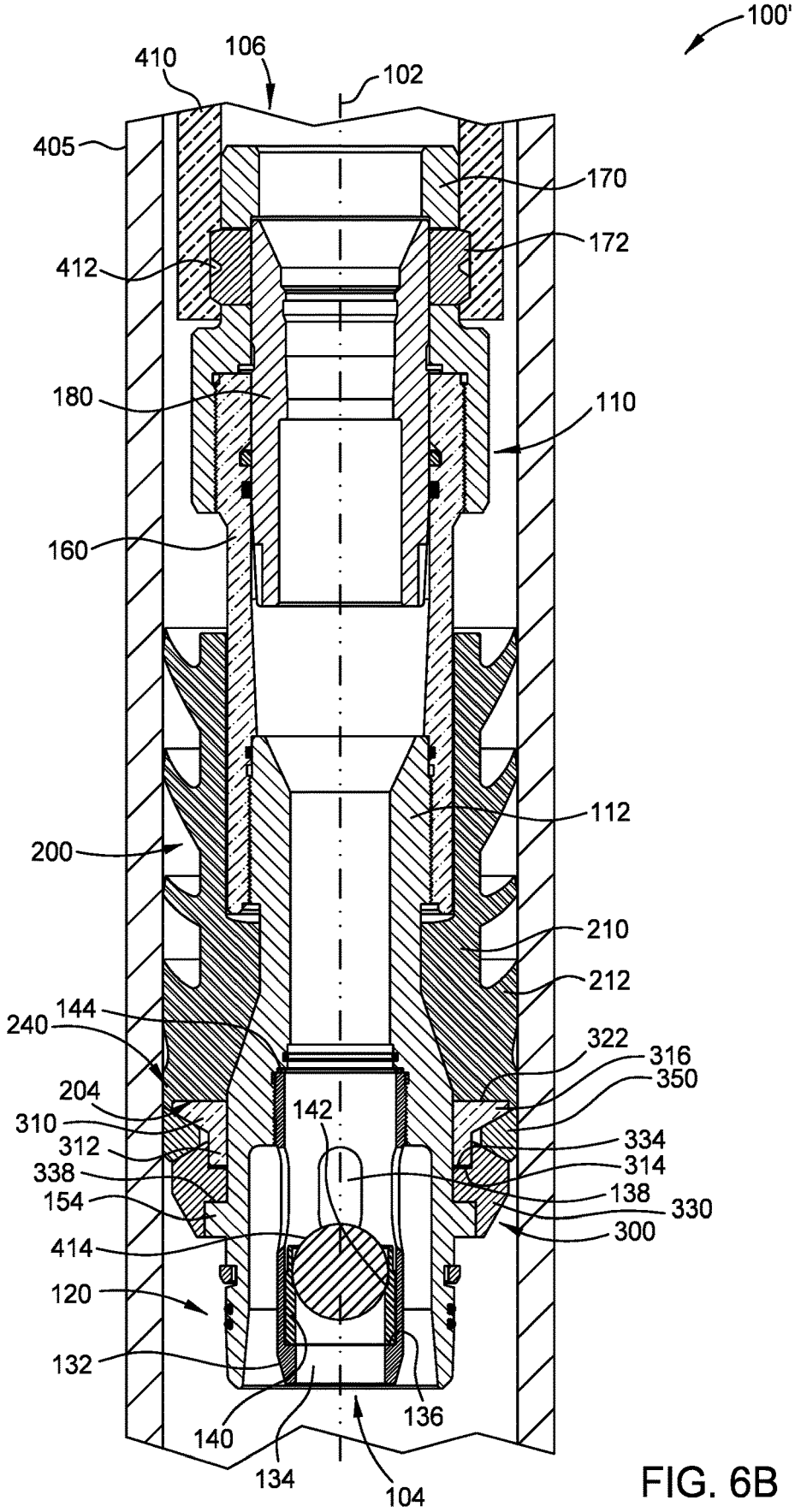
FIG. 6B is a longitudinal cross-sectional view of an embodiment of the wiper plug of FIG. 1 during the exemplary phase of operation of FIG. 6A.

FIG. 6B illustrates a continuation of the operation depicted in FIG. 5B, and shows the wiper plug 100' after the release of the lower seat sleeve 140. The lower seat sleeve 140 and the ball 414 move into the catcher 132; the lower seat sleeve 140 rests against the ledge 136 around the end port 134 of the catcher 132. Fluid communication through the wiper plug 100' is now reestablished since fluid may travel through the one or more side ports 138 of the catcher 132.

FIG. 6B illustrates the ductile ring 350 remaining radially outwardly deformed to an extent similar to that depicted in FIG. 5B. However, in some embodiments, it is contemplated that the ductile ring 350 may become at least partially radially retracted. For example, the reestablishment of fluid communication through the wiper plug 100' results in a reduction of the pressure exerted on the seal unit 200. Because of the resilient nature of the material of the seal unit 200, the seal unit 200 may return back towards the shape and positioning shown in FIG. 1. Such a return may reduce the force exerted by the seal unit 200 on the setting ring 310. In embodiments in which the ductile ring 350 retains at least some resiliency, the ductile ring 350 may at least partially retract back towards the shape and positioning shown in FIG. 1.

Figure 7A:
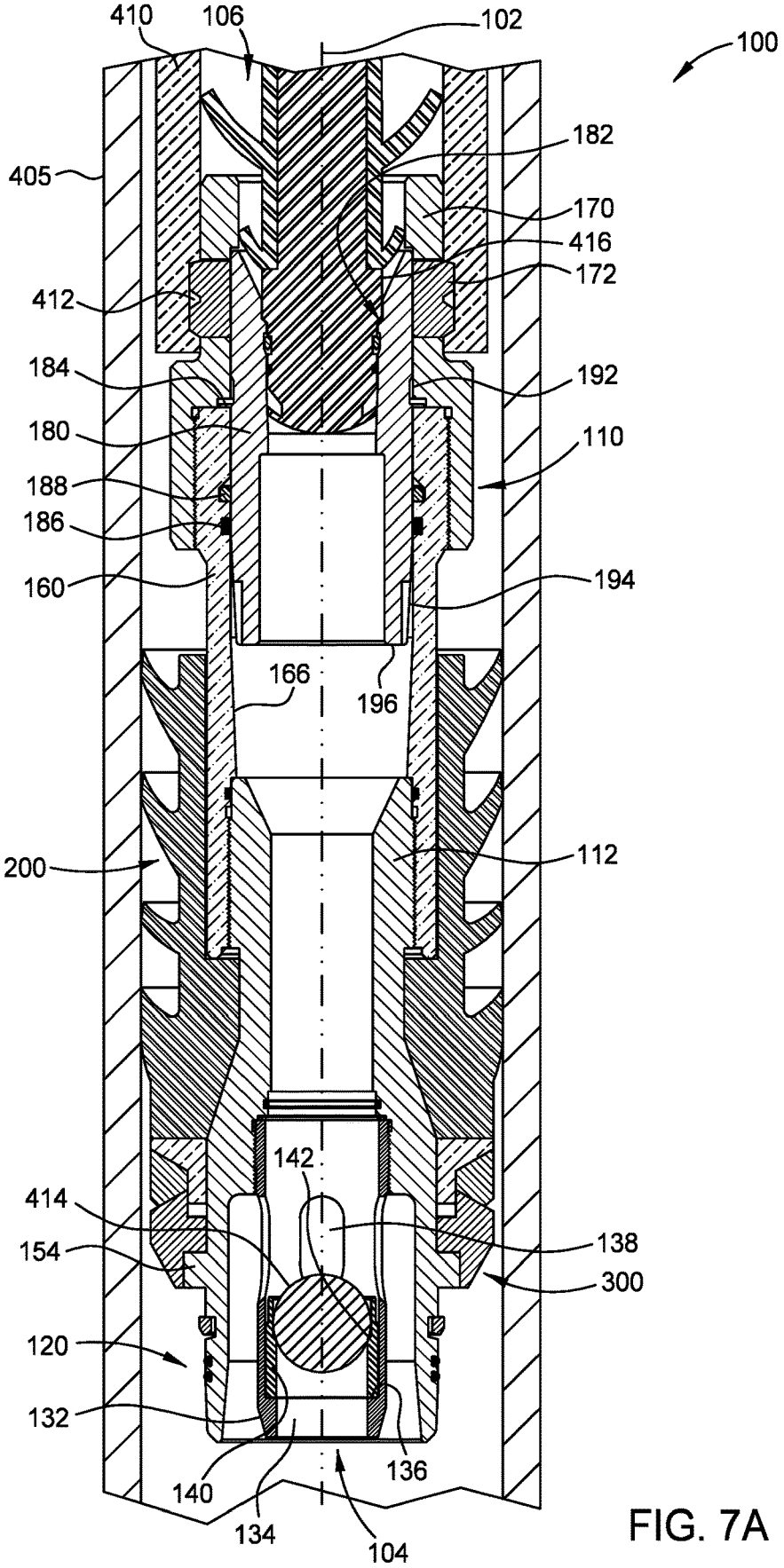
FIG. 7A is a longitudinal cross-sectional view of the wiper plug of FIG. 1 during an exemplary phase of operation.

In some embodiments, it is contemplated that the operations illustrated in FIGS. 5A to 6B of landing the first obturating object in the lower seat sleeve 140 and releasing the lower seat sleeve 140 may be omitted. FIG. 7A illustrates not only a continuation of the operation depicted in FIG. 6A, but also relevant operations for embodiments in which landing the first obturating object in the lower seat sleeve 140 and releasing the lower seat sleeve 140 are omitted. A cement slurry is pumped into the wellbore and through the wiper plug 100. A second obturating object, shown in FIG. 7A as a dart 416, is dropped into the wellbore, and conveyed by gravity and/or by pumping a displacement fluid, such as a drilling fluid, through a work string (not shown) to the wiper plug 100. In FIG. 7A, the dart 416 is illustrated as having landed on the profile 182 of the upper seat sleeve 180. The dart 416 landed on the profile 182 of the upper seat sleeve 180 blocks fluid communication through the wiper plug 100.

Figure 7B:
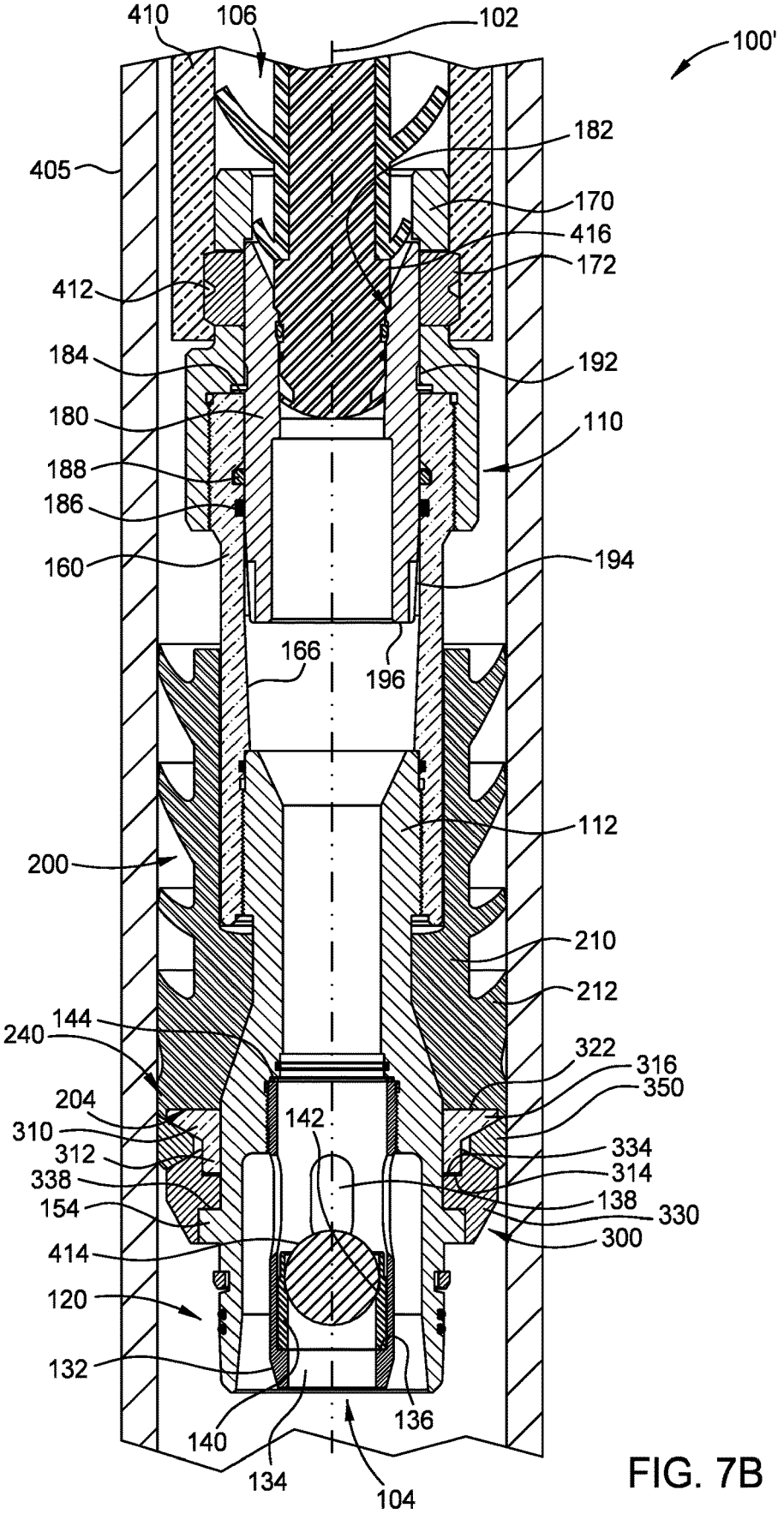
FIG. 7B is a longitudinal cross-sectional view of an embodiment of the wiper plug of FIG. 1 during the exemplary phase of operation of FIG. 7A.

FIG. 7B illustrates a continuation of the operation depicted in FIG. 6B. FIG. 7B also illustrates relevant operations for embodiments of wiper plug 100' in which landing the first obturating object in the lower seat sleeve 140 and releasing the lower seat sleeve 140 are omitted. A cement slurry is pumped into the wellbore and through the wiper plug 100'. As described with respect to FIG. 7A, the second obturating object, shown in FIG. 7B as dart 416, is dropped into the wellbore, and conveyed by gravity and/or by pumping a displacement fluid, such as a drilling fluid, through a work string (not shown) to the wiper plug 100'. In FIG. 7B, the dart 416 is illustrated as having landed on the profile 182 of the upper seat sleeve 180. The dart 416 landed on the profile 182 of the upper seat sleeve 180 blocks fluid communication through the wiper plug 100'.

FIG. 7B shows the anti-extrusion assembly 300 of wiper plug 100' is at least partially energized when pressure is exerted against the dart 416. In some embodiments, it is contemplated that the energizing of the anti-extrusion assembly 300 may result from a preload applied by the seal unit 200, such as described above. Alternatively, or additionally, in some embodiments it is contemplated that the energizing of the anti-extrusion assembly 300 may result from the pressure exerted against the dart 416 also being exerted against the seal unit 200 in the annular space 408 between the mandrel 110 and the tubular 405. For example, pressure exerted against the dart 416 may be communicated to the annular space 408 via a port in the support 410 and/or around the one or more retainers 172. It is contemplated that the preload and/or pressure exerted on the seal unit 200 may result in a force being transferred from the seal unit 200 to the first surface 322 of the projection 316 of the setting ring 310 of the anti-extrusion assembly 300.

Figure 8A:
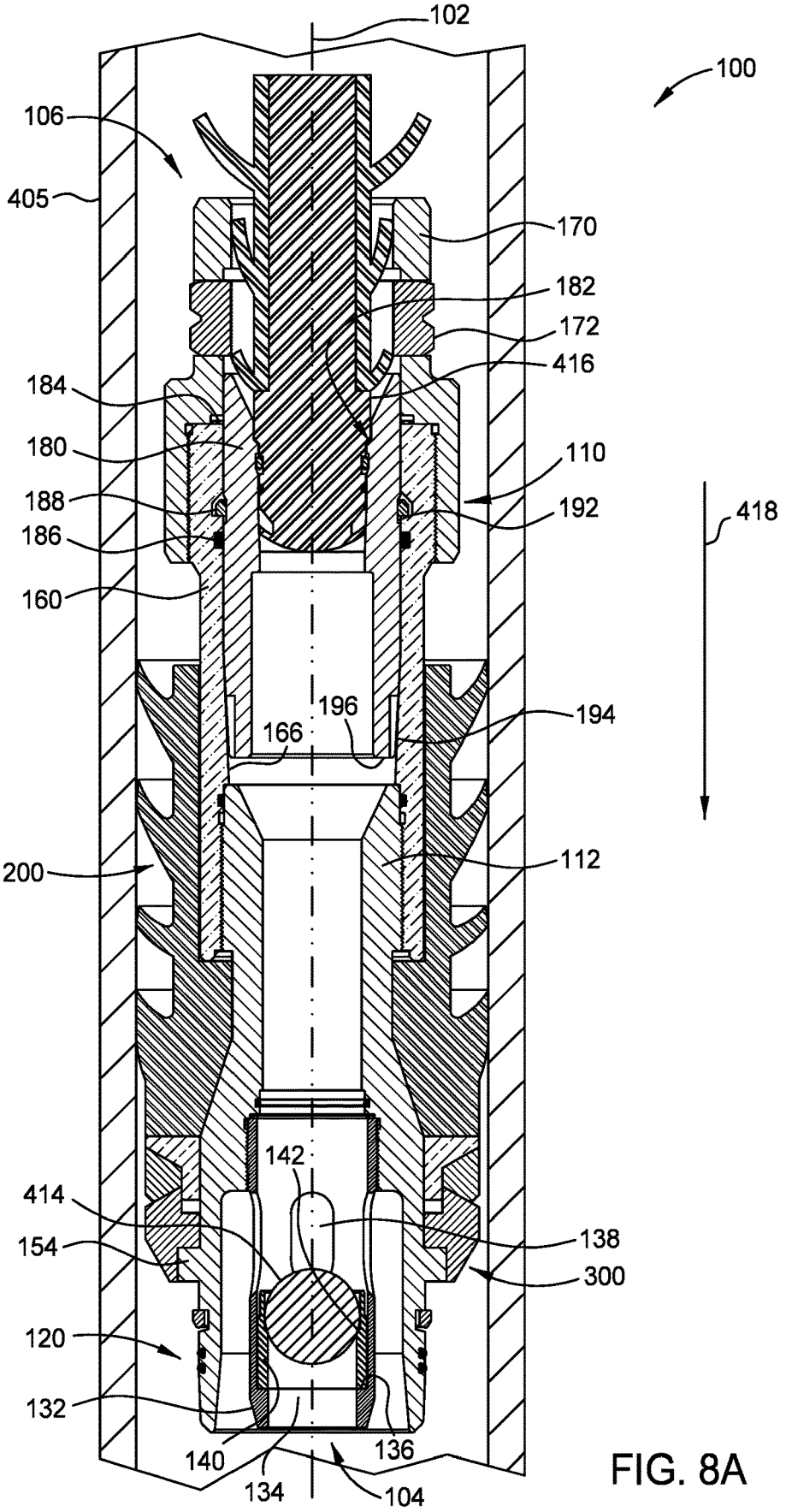
FIG. 8A is a longitudinal cross-sectional view of the wiper plug of FIG. 1 during an exemplary phase of operation.

FIG. 8A illustrates a continuation of the operation depicted in FIG. 7A, and shows the wiper plug 100 after the release of the upper seat sleeve 180. The application of pressure against the dart 416 to a third threshold causes the release of the upper seat sleeve 180. For example, the force on the upper seat sleeve 180 resulting from the pressure may cause the releasable fastener 184 to fail. The upper seat sleeve 180 and the dart 416 move down until the external taper 194 of the upper seat sleeve 180 engages the taper 166 of the bore 164 of the center mandrel segment 160 and the lock ring 188 in the center mandrel segment 160 engages the recess 192 in the upper seat sleeve 180. In some embodiments, it is contemplated that the external taper 194 of the upper seat sleeve 180 and/or the taper 166 of the bore 164 of the center mandrel segment 160 may be omitted. In some embodiments, it is contemplated that the upper seat sleeve 180 and the dart 416 move down until the engagement between the lock ring 188 in the center mandrel segment 160 and the recess 192 in the upper seat sleeve 180 prevents further downward movement of the upper seat sleeve 180. In some embodiments, it is contemplated that the upper seat sleeve 180 and the dart 416 move down until the lower end 196 of the upper seat sleeve 180 engages a portion of the lower mandrel segment 112.

When the upper seat sleeve 180 moves down past each opening 174 in the upper mandrel segment 170, each corresponding retainer 172 is no longer prevented from moving radially inward. Continued application of pressure to the dart 416 results in a downward force on the wiper plug 100 which promotes the radial inward movement of each retainer 172 due to the interaction between each retainer and the corresponding recess 412 of the support 410. The radial inward movement of each retainer 172 thus releases the wiper plug 100 from the support 410. Because at least one of the fins 212, 214, 216, 218 of the seal unit 200 provides a seal against the tubular 405, pressure applied to the displacement fluid results in a corresponding force imparted onto the wiper plug 100. Thus, continued pumping of the displacement fluid moves the wiper plug 100 through the tubular 405 in the direction shown by arrow 418. Hence, the leading end 104 of the wiper plug 100 faces in the direction of travel 418, and the trailing end 106 of the wiper plug 100 faces against the direction of travel 418.

Figure 8B:
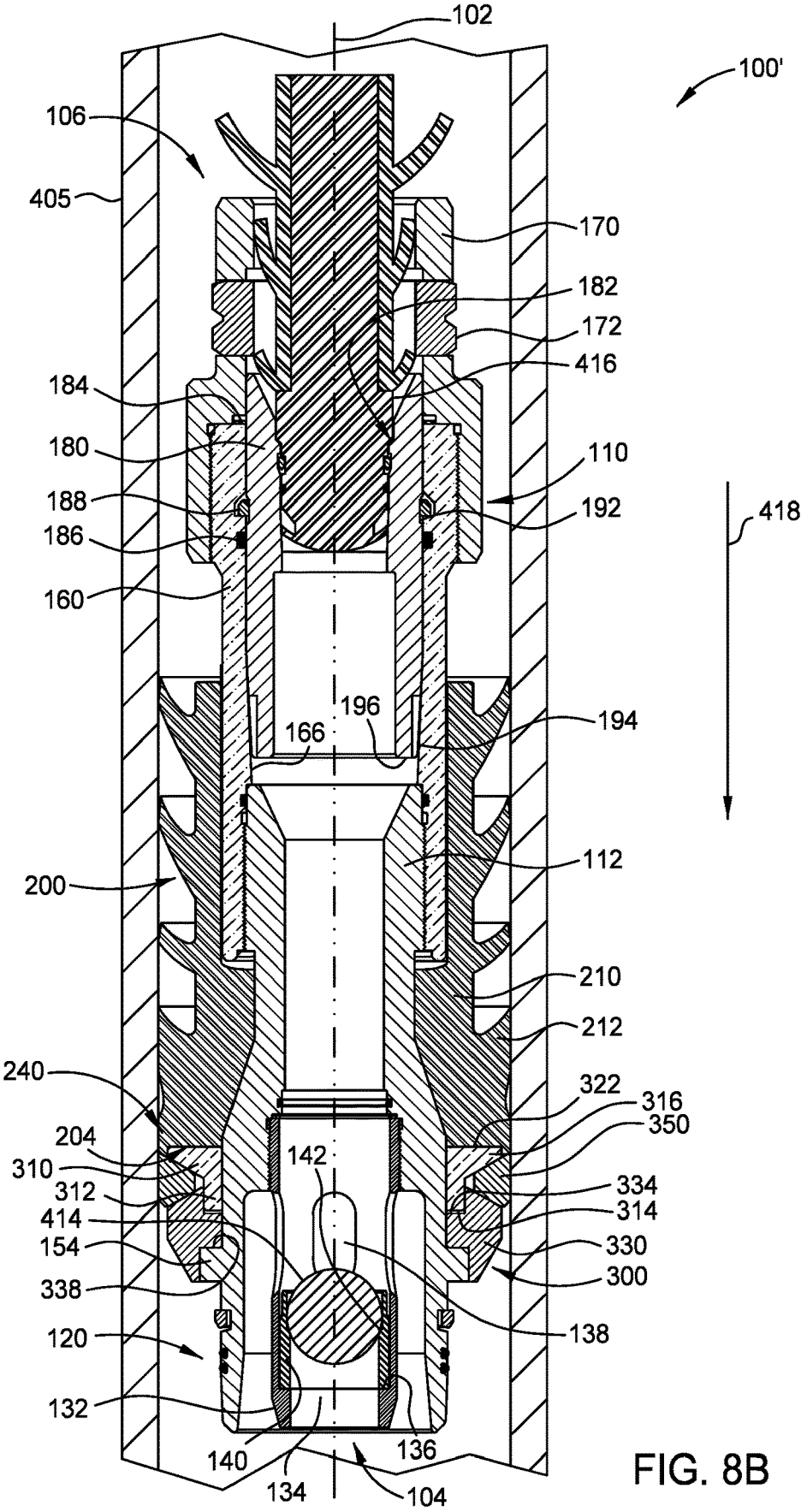
FIG. 8B is a longitudinal cross-sectional view of an embodiment of the wiper plug of FIG. 1 during the exemplary phase of operation of FIG. 8A.

FIG. 8B illustrates a continuation of the operation depicted in FIG. 7B, and shows the wiper plug 100' after the release of the upper seat sleeve 180. The application of pressure against the dart 416 to a third threshold causes the release of the upper seat sleeve 180. For example, the force on the upper seat sleeve 180 resulting from the pressure may cause the releasable fastener 184 to fail. The upper seat sleeve 180 and the dart 416 move down until the external taper 194 of the upper seat sleeve 180 engages the taper 166 of the bore 164 of the center mandrel segment 160 and the lock ring 188 in the center mandrel segment 160 engages the recess 192 in the upper seat sleeve 180. In some embodiments, it is contemplated that the external taper 194 of the upper seat sleeve 180 and/or the taper 166 of the bore 164 of the center mandrel segment 160 may be omitted. In some embodiments, it is contemplated that the upper seat sleeve 180 and the dart 416 move down until the engagement between the lock ring 188 in the center mandrel segment 160 and the recess 192 in the upper seat sleeve 180 prevents further downward movement of the upper seat sleeve 180. In some embodiments, it is contemplated that the upper seat sleeve 180 and the dart 416 move down until the lower end 196 of the upper seat sleeve 180 engages a portion of the lower mandrel segment 112.

When the upper seat sleeve 180 moves down past each opening 174 in the upper mandrel segment 170, each corresponding retainer 172 is no longer prevented from moving radially inward. Continued application of pressure to the dart 416 results in a downward force on the wiper plug 100' which promotes the radial inward movement of each retainer 172 due to the interaction between each retainer and the corresponding recess 412 of the support 410. The radial inward movement of each retainer 172 thus releases the wiper plug 100' from the support 410. Because at least one of the fins 212, 214, 216, 218 of the seal unit 200 provides a seal against the tubular 405, pressure applied to the displacement fluid results in a corresponding force imparted onto the wiper plug 100'. Thus, continued pumping of the displacement fluid moves the wiper plug 100' through the tubular 405 in the direction shown by arrow 418. Hence, the leading end 104 of the wiper plug 100' faces in the direction of travel 418, and the trailing end 106 of the wiper plug 100' faces against the direction of travel 418.

FIG. 8B illustrates the ductile ring 350 remaining radially outwardly deformed to an extent similar to that depicted in FIG. 7B. However, in some embodiments, it is contemplated that the ductile ring 350 may become at least partially radially retracted. For example, the release of the wiper plug 100' from the support 410 may result in pressures above and below the seal unit 200 becoming substantially balanced, such as within 50 psi (3.45 bar). Because of the resilient nature of the material of the seal unit 200, the seal unit 200 may return back towards the shape and positioning shown in FIG. 1. Such a return may reduce the force exerted by the seal unit 200 on the setting ring 310. In embodiments in which the ductile ring 350 retains at least some resiliency, the ductile ring 350 may at least partially retract back towards the shape and positioning shown in FIG. 1.

Figure 9:
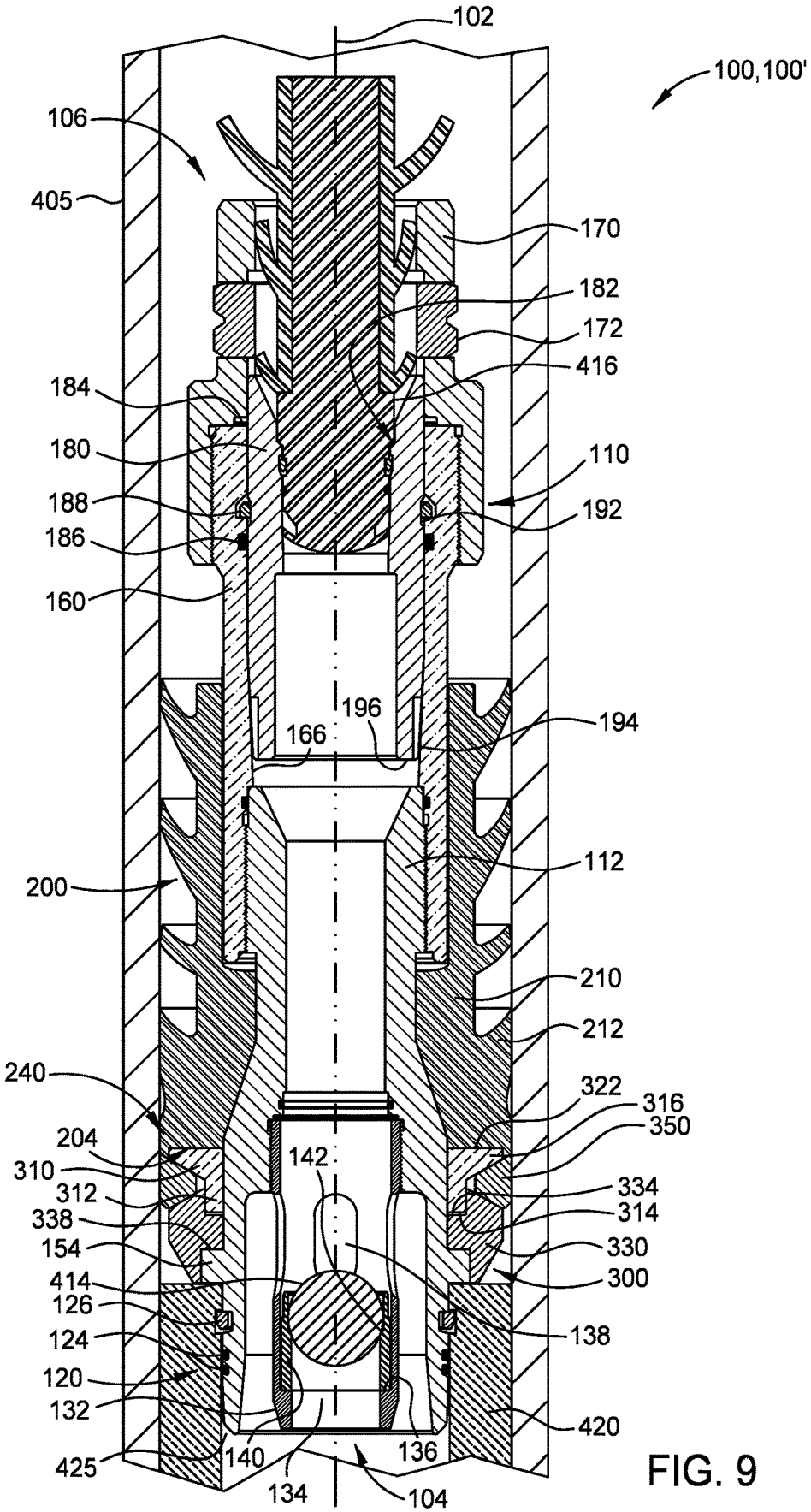
FIG. 9 is a longitudinal cross-sectional view of the wiper plug of FIG. 1 during an exemplary phase of operation.

Displacement of the wiper plug 100, 100' through the tubular 405 causes the cement slurry to be moved through the tubular 405 and into an annulus surrounding the tubular 405. FIG. 9 illustrates a continuation of the operations depicted in FIGS. 8A and 8B, and depicts a termination of the travel of the wiper plug 100, 100' through the tubular 405. The wiper plug 100, 100' is engaged with a collar 420 in the tubular 405. The collar 420 has a bore 425 configured to receive at least part of the nose portion 120 of the mandrel 110 of the wiper plug 100, 100'. FIG. 9 illustrates the bore 425 receiving the one or more seals 124 and the lock ring 126 of the nose portion 120 of the mandrel 110 of the wiper plug 100, 100'.

FIG. 9 illustrates the anti-extrusion assembly 300 in an energized condition. In some embodiments, it is contemplated that the anti-extrusion assembly 300 is not in an energized condition after the wiper plug 100, 100' has landed in the collar 420. In some embodiments, it is contemplated that the anti-extrusion assembly 300 is in an energized condition after the wiper plug 100, 100' has landed in the collar 420. In some embodiments, it is contemplated that the energizing of the anti-extrusion assembly 300 may occur prior to the wiper plug 100' landing in the collar 420, such as in any one or more of the operations depicted in FIGS. 5B, 6B, 7B, and/or 8B, and that the anti-extrusion assembly 300 remains at least partially energized after the wiper plug 100' has landed in the collar 420.

In some embodiments, it is contemplated that the energizing of the anti-extrusion assembly 300 may result from a preload applied by the seal unit 200, such as described above. Alternatively, or additionally, in some embodiments it is contemplated that the energizing of the anti-extrusion assembly 300 may result from a continued application of pressure applied to the displacement fluid after the wiper plug 100, 100' has landed in the collar 420. For example, in conducting a pressure test following the landing of the wiper plug 100, 100' in the collar 420, pressure applied to the displacement fluid may result in a force being transferred from the seal unit 200 to the first surface 322 of the projection 316 of the setting ring 310 of the anti-extrusion assembly 300.

As illustrated in FIG. 9, a force of sufficient magnitude applied via the seal unit 200 to the setting ring 310 of the anti-extrusion assembly 300 causes the setting ring 310 to move toward the retaining ring 330. As described above, the retaining ring 330 is prevented from moving away from the setting ring 310, and therefore movement of the setting ring 310 toward the retaining ring 330 compresses the ductile ring 350, resulting in deformation of the ductile ring 350.

The configuration of the second surface 324 of the projection 316 of the setting ring 310, the first 352 and second 354 surfaces of the ductile ring 350, and the corresponding surface 342 of the retaining ring 330 promote deformation of the ductile ring 350 radially outward such that an outer diameter of the ductile ring 350 becomes enlarged, as illustrated in FIG. 9. In some embodiments, it is contemplated that the outer diameter of the ductile ring 350 may become enlarged to the extent that the ductile ring 350 contacts the tubular 405. In some embodiments, it is contemplated that the ductile ring 350 makes a 360 degree contact with the tubular 405. In other embodiments, it is contemplated that the ductile ring 350 may not contact the tubular 405. In some embodiments, it is contemplated that the extent to which the ductile ring 350 may be deformed outwardly from between the projection 316 of the setting ring 310 and the retaining ring 330 is limited at least in part by the end 314 of the base 312 of the setting ring contacting the first shoulder 334 of the first recess 332 of the retaining ring 330.

Additionally, the force imparted on the seal unit 200 by the pressure applied on the displacement fluid may cause at least a portion 240 of the seal unit 200 to become extruded, as exemplified in FIG. 9. It is contemplated that a susceptibility of the seal unit 200 to extrusion may be exacerbated by exposure to the elevated temperatures that typically exist in wellbores. Extrusion of a fin 212/214/216/218 of the seal unit 200 may compromise the integrity of the seals between the fin 212/214/216/218 and the surrounding tubular 405. However for the wiper plug 100, 100' of the present disclosure, as shown in FIG. 9, extrusion of the seal unit 200 at the leading end 204 of the seal unit 200 is limited by the anti-extrusion assembly 300. Thus, extrusion of the leading end 204 is restricted, and extrusion of the seal unit at the leading fin 212 is inhibited. Hence, sealing integrity of at least the leading fin 212 against the surrounding tubular 405 is maintained.

In the operations described above with respect to FIGS. 5A to 9, extrusion of the body 210 of the seal unit 200 may compromise the integrity of the seal between the seal unit 200 and the mandrel 110 of the wiper plug 100, 100'. However, the interaction between the seal unit 200 and the slope 118 of the lower mandrel segment 112 limits extrusion of the body 210 of the seal unit 200, and limits the degree to which sealing contact between the seal unit 200 and the lower mandrel segment 112 may be compromised. Additionally, in embodiments in which the mounting of the seal unit 200 around the mandrel 110 is configured to be an interference fit, it is contemplated that the interference fit may assist in maintaining the integrity of the seal between the seal unit 200 and the lower mandrel segment 112.

Hence, wiper plugs 100, 100' of the present disclosure provide for at least a portion of the seal unit 200 to be maintained in sealing contact with the mandrel 110 and at least a portion of the seal unit 200 to be maintained in sealing contact with the surrounding tubular 405, and integrity of the seals is preserved.

While the foregoing is directed to embodiments of the present disclosure, other and further embodiments of the disclosure may be devised without departing from the basic scope thereof, and the scope thereof is determined by the claims that follow.

What is claimed is:

1. A wiper plug comprising:

a mandrel having a nose portion at a leading end thereof;

a seal unit disposed about the mandrel, the seal unit including a body and one or more fins extending outwardly from the body; and an anti-extrusion assembly disposed about the mandrel at a leading end of the seal unit, the anti-extrusion assembly arranged to transition between a first configuration, in which the anti-extrusion assembly is not energized, and a second configuration, in which the anti-extrusion assembly is energized;

wherein the nose portion protrudes beyond the anti-extrusion assembly, and the anti-extrusion assembly further comprises:

a setting ring disposed adjacent the seal unit;

a retaining ring; and a ductile ring disposed between the setting ring and the retaining ring.

2. The wiper plug of claim 1, wherein when the anti-extrusion assembly transitions to the second configuration, the setting ring moves axially on the mandrel towards the retaining ring, thereby deforming the ductile ring from a radially retracted condition to a radially extended condition.

3. The wiper plug of claim 2, wherein the setting ring includes:

a base disposed between the ductile ring and the mandrel; and a projection extending radially from the base, the projection disposed between the seal unit and the ductile ring.

4. The wiper plug of claim 3, wherein the base includes an extension between a portion of the retaining ring and the mandrel.

5. The wiper plug of claim 4, wherein movement of the setting ring is limited by the extension contacting a shoulder.

6. The wiper plug of claim 3, wherein the projection has a first surface facing the ductile ring, the first surface tapering from a location proximal to the retaining ring at the base to a location distal from the retaining ring at an outer edge of the projection.

7. The wiper plug of claim 6, wherein the retaining ring has a second surface facing the ductile ring and having:

a radially inner location axially proximal to the projection of the setting ring; and a radially outer location axially distal from the projection of the setting ring.

8. The wiper plug of claim 1, wherein:

an outer surface of the mandrel includes a slope;

a first outer diameter of the mandrel at a first end of the slope proximal to the leading end of the mandrel is greater than a second outer diameter of the mandrel at a second end of the slope distal from the leading end of the mandrel; and the seal unit includes an inner surface having a first internal taper disposed adjacent the slope.

9. The wiper plug of claim 8, wherein the inner surface of the seal unit includes a second internal taper disposed between the first internal taper and an internal shoulder extending substantially perpendicular to a longitudinal axis of the mandrel.

10. A wiper plug comprising:

a mandrel;

a seal unit disposed about the mandrel, the seal unit including a body and one or more fins extending outwardly from the body; and an anti-extrusion assembly disposed about the mandrel at a leading end of the seal unit, the anti-extrusion assembly arranged to transition between a first configuration, in which the anti-extrusion assembly is not energized, and a second configuration, in which the anti-extrusion assembly is energized, in response to a pressure applied to an obturating object landed in the wiper plug.

11. The wiper plug of claim 10, wherein the anti-extrusion assembly further comprises:

a setting ring disposed adjacent the seal unit;

a retaining ring; and a ductile ring disposed between the setting ring and the retaining ring.

12. The wiper plug of claim 11, wherein when the anti-extrusion assembly transitions to the second configuration, the setting ring moves axially on the mandrel towards the retaining ring, thereby deforming the ductile ring from a radially retracted condition to a radially extended condition.

13. The wiper plug of claim 12, wherein the setting ring includes:

a base disposed between the ductile ring and the mandrel; and a projection extending radially from the base, the projection disposed between the seal unit and the ductile ring.

14. The wiper plug of claim 13, wherein the base extends between a portion of the retaining ring and the mandrel.

15. The wiper plug of claim 14, wherein movement of the setting ring is limited by the extension contacting a shoulder.

16. A method comprising:

suspending a wiper plug from a support disposed in a tubular; and energizing an anti-extrusion assembly of the wiper plug while the wiper plug remains suspended from the support, the energizing comprising:

landing an obturating object in the wiper plug; and applying a pressure to the landed obturating object.

17. The method of claim 16, wherein energizing the anti-extrusion assembly further comprises:

communicating the applied pressure to a seal unit of the wiper plug, thereby causing the seal unit to apply a force to the anti-extrusion assembly.

18. The method of claim 17, wherein the force causes a setting ring of the anti-extrusion assembly to move relative to a retaining ring, thereby deforming a ductile ring disposed between the setting ring and the retaining ring from a radially retracted condition to a radially extended condition.

19. The method of claim 16, further comprising releasing the wiper plug from the support after energizing the anti-extrusion device.

* * * * *